US007050358B2

(12) United States Patent
Garay et al.

(10) Patent No.: US 7,050,358 B2
(45) Date of Patent: May 23, 2006

(54) ELECTRONIC DEVICE WITH SECONDARY DISPLAY PROJECTION

(75) Inventors: John L. Garay, Southbury, CT (US); Surendar Bhan, Watertown, CT (US); Bernd Becker, Southbury, CT (US)

(73) Assignee: Timex Group B.V. (NL)

( * ) Notice: Subject to any disclaimer, the term of this patent is extended or adjusted under 35 U.S.C. 154(b) by 0 days.

(21) Appl. No.: 10/953,169

(22) Filed: Sep. 29, 2004

(65) Prior Publication Data

US 2006/0067167 A1 Mar. 30, 2006

(51) Int. Cl.
*G04B 19/32* (2006.01)

(52) U.S. Cl. ..... 368/67; 368/226

(58) Field of Classification Search ..... 368/67, 368/223, 226, 227, 228, 232, 234, 79, 82; 362/23

See application file for complete search history.

(56) References Cited

U.S. PATENT DOCUMENTS 4,527,096 A * 7/1985 Kindlmann ..... 315/169.3
4,775,964 A * 10/1988 Alessio et al. ..... 368/67
5,691,962 A * 11/1997 Schwartz et al. ..... 368/71
5,764,599 A * 6/1998 Thorgersen et al. ..... 368/226

* cited by examiner

*Primary Examiner*—Kamand Cuneo
*Assistant Examiner*—Jeanne-Marguerite Goodwin
(74) *Attorney, Agent, or Firm*—Carmody & Torrance LLP

(57) ABSTRACT

An electronic device comprising a secondary display made up of a plurality of display segments each of which is made up of a multilayered assembly comprising a transparent substrate having a first and a second surface; a transparent electrically conductive layer formed on the second surface of the transparent substrate; an electroluminescent layer formed on the transparent conductive layer; an insulating layer formed on the electroluminescent layer; and an electrically conductive layer formed on the insulating layer; and including means for selectively illuminating electroluminescent layers of each of the plurality of display segments, wherein light emanating from the illuminated electroluminescent layers during an illuminated condition passes through the transparent substrate; whereby secondary information is provided by the selected illumination of the electroluminescent layers.

13 Claims, 2 Drawing Sheets

ELECTRONIC DEVICE WITH SECONDARY DISPLAY PROJECTION

BACKGROUND OF THF INVENTION

The present invention relates generally to timepieces with a date display, and in particular, to an electronic device, such as a timepiece, that can tell time or convey other information using hands (e.g. in an "analog" manner), while also being able to convey yet further information, such as the date by way of example, by selectively illuminating electroluminescent layers arranged about and/or in a multilayered dial assembly.

The "digital" watch has been around for several decades. Those who were around at the "beginning" might readily recall the use of 7 segment displays to indicate the time and date. Actuation of a pusher, most often a side pusher, activated the LED segments of the LED digits of the LED display, which themselves were controlled by a microcontroller, thereby providing the time on the LED display. Also well known in the prior art is the use of liquid crystal segmented displays (LCD) to display the date.

At least most of the known "analog" type watches that have date displays use date wheels, the mechanical technology therefore being well known in the art. At least one watch style is known to provide an LCD layer above the dial, thereby using conventional hands to display the time while using the LCD to display the date. Also well known is the "combo" watch, such as that disclosed in U.S. Pat. No. 5,691,962. However, a perceived deficiency in such designs and in the combo watch in particular is that they are thought to be less than aesthetically pleasing.

Accordingly, it would be desirable to provide an electronic device, such as an analog timepiece, that utilizes an analog movement for telling time and/or providing other information, while using more modern electroluminescent technology, such as that described in U.S. Pat. Nos. 4,527,096 and 4,775,964, to provide date and/or still further information, which may be more aesthetically pleasing and/or inexpensive to manufacture than those constructions described above. A unique configuration whereby the secondary display is incorporated onto and/or into the dial itself, is believed to be novel, unobvious and advantageous over the prior art.

SUMMARY AND OBJECTS OF THE INVENTION

Accordingly, it is an objective of the present invention to provide an electronic device, such as a timepiece, with a secondary display that conveys information via a plurality of selectively illuminable electroluminescent layers arranged about and/or in a dial assembly.

Still another object of the present invention to provide an analog timepiece with a secondary display of the type disclosed herein that is inexpensive and easy to manufacture.

Still another object of the present invention is to provide an electronic device, such as a timepiece, in which size of the date or other information desirous of display on the secondary display can be increased, while maintaining visual aesthetic appeal to the user.

It is still a further objective of the present invention to provide a timepiece with a date display that need not be adjusted at least five (5) times a year.

It is still a further objective of the present invention to provide an electronic device that has the versatility that is further disclosed herein.

Still other objects and advantages of the invention will in part be obvious and will in part be apparent from the specification.

The invention accordingly comprises the features of construction, combination of elements, arrangement of parts and sequence of steps which will be exemplified in the construction, illustration and description hereinafter set forth, and the scope of the invention will be indicated in the claims.

Generally speaking, in accordance with the present invention, an electronic device that includes a secondary display for displaying secondary information is provided. In a preferred embodiment, the secondary display is made up of a plurality of display segments each of which is made up of a multilayered assembly comprising a transparent substrate having a first and a second surface; a transparent electrically conductive layer formed on the second surface of the transparent substrate; an electroluminescent layer formed on the transparent conductive layer; an insulating layer formed on the electroluminescent layer; and an electrically conductive layer formed on the insulating layer; and including means for selectively illuminating electroluminescent layers of each of the plurality of display segments, wherein light emanating from the illuminated electroluminescent layers during an illuminated condition passes through the transparent substrate; whereby secondary information is provided by the selected illumination of the electroluminescent layers.

In a specific embodiment, the electronic device disclosed herein is a timepiece, and comprises an actuation mechanism, operatively coupled to one or more hands, for rotation thereof at least in one of a clockwise and counterclockwise direction; and a dial, positioned intermediate the one or more hands and the actuation mechanism, wherein the dial comprises a plurality of display segments each of which is made up of a multilayered assembly as set forth above, wherein light emanating from the illuminated electroluminescent layers during an illuminated condition passes through the transparent substrate; whereby secondary information is provided by the selected illumination of the electroluminescent layers.

BRIEF DESCRIPTION OF THE DRAWINGS

For a fuller understanding of the invention, reference is had to the following description taken in connection with the accompanying figures, in which.

Also, while not all elements may not be labeled in each figure, all elements with the same reference number indicate similar or identical parts.

DETAILED DESCRIPTION OF THE PREFERRED EMBODIMENTS

Figure 1:
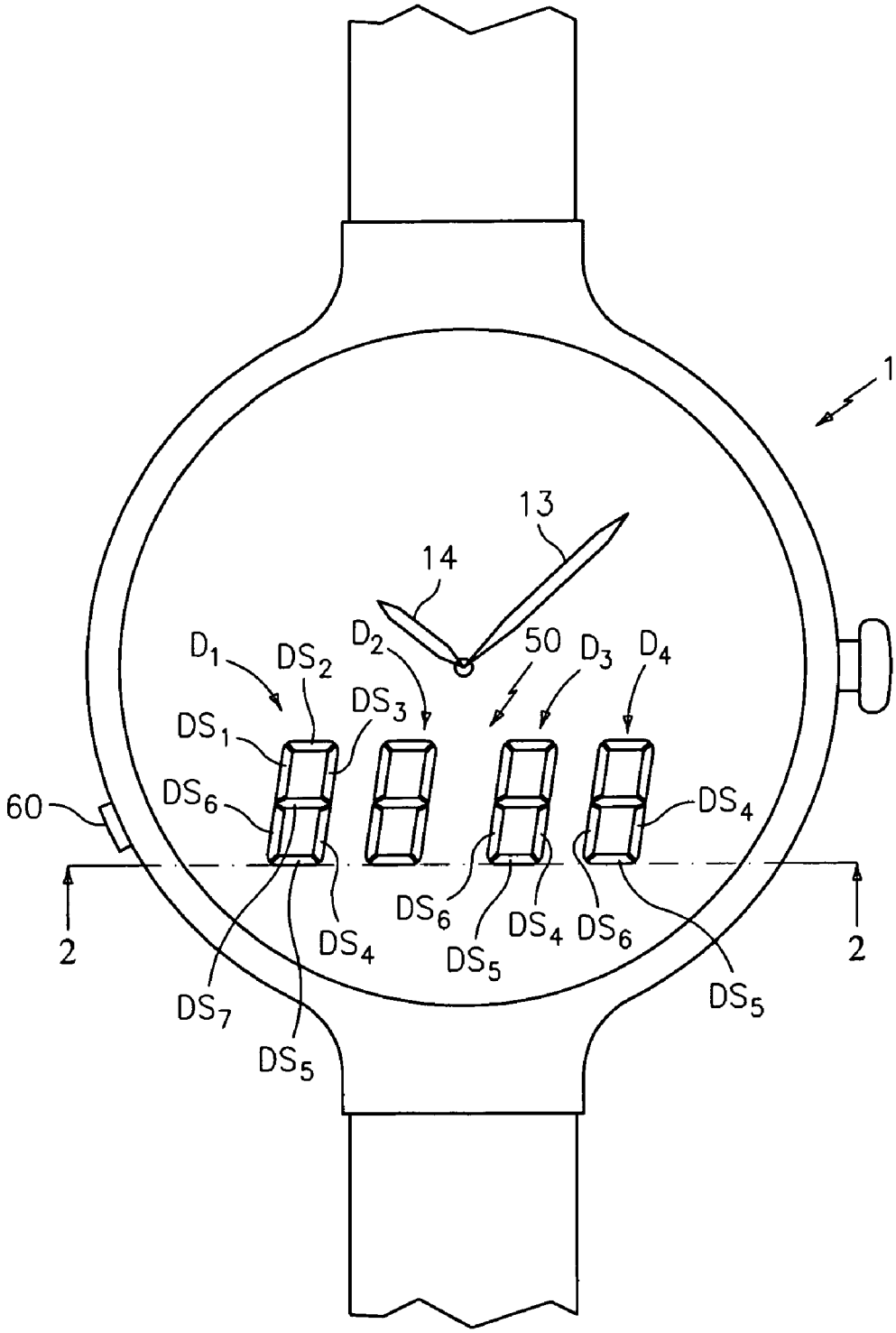
FIG. 1 is an exemplary electronic device with a secondary display constructed in accordance with the present invention.
Figure 2:
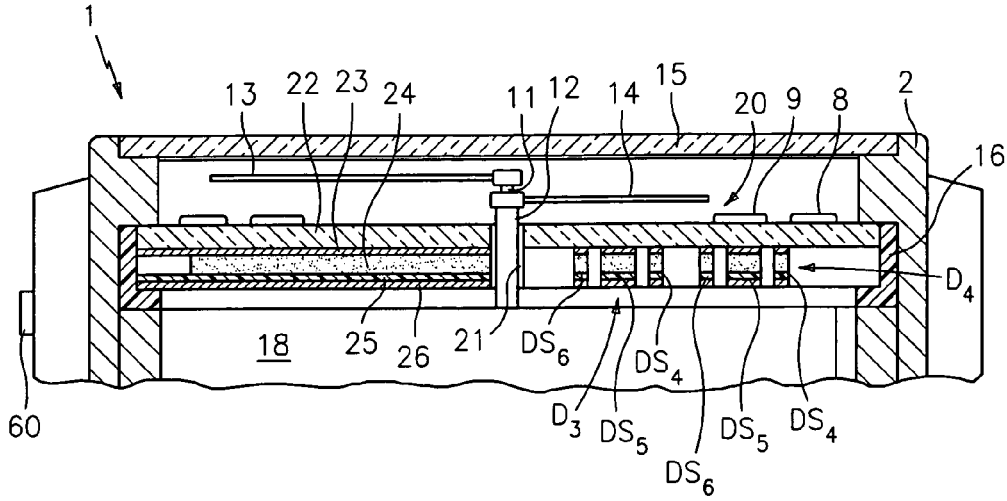
FIG. 2 is a cross-sectional view of the electronic device taken about lines 2—2 of FIG. 1, illustrating among other things, the display segments positioned consistent with that set forth in FIG. 1.

Reference will now be made to FIGS. 1–2, for a disclosure of an electronic device, generally indicated at 1, constructed in accordance with the present invention. In the preferred embodiment, electronic device 1 is a timepiece, and a wristwatch in particular, but this is by way of example and not limitation, as other devices, such as a heartrate monitor and/or compass are clearly contemplated herein. To be sure, all the devices that are disclosed in copending and coowned application Ser. No. 10/441,417, the disclosure of which is incorporated by reference as if fully set forth herein, are equally applicable to the present invention, and thus contemplated hereby.

FIGS. 1–2 illustrate electronic device 1 comprising a conventional case 2. For the "analog" portion of the present invention and the display of "first" information, a minute hand 13 and an hour hand 14 are mounted on rotateable stems (respectively 11, 12). In the event electronic device 1 is not a conventional timepiece, but rather some other device, such as a compass and/or heartrate monitor by way of example and not limitation, reference should be had to the aforementioned application Ser. No. 10/441,417. In this way, the claimed "display hand" will find correspondence for any of the hands disclosed therein, such as one of the "dash" hands or the fourth hand, as well as the minute, second or hour hand when device 1 is a timepiece.

As illustrated in FIG. 2 by reference numeral 18, hands 13 and 14 are driven by a conventional movement, such as an actuation mechanism, which in the preferred embodiment comprises a stepper motor that itself comprises a rotor, the stepper motor being operatively coupled to the hour and minute hand, for stepping in at least one of a clockwise and counterclockwise direction in predefined increments. Not material to the present invention, but well understood by one ordinarily skilled in the art, minute and hour hands 13, 14 have a gear train operatively coupled thereto, wherein the rotational activity generated by the rotor of the stepper motor is conveyed to the gear train which in turn causes the rotation of the hour and minute hands. The stepping motor is actuated by an integrated circuit with a quartz time base and driving a gear train coupled to stems 11, 12 in a manner well known in the art. Case 2 includes a transparent crystal 15 through which to observe hands 13, 14 and their position in relation to indicia 8, 9 on dial 20, which may be time indicating indicia, such as the hour and minute markers and provided thereon by a variety of methods, such as printing, painting and/or silk-screening, using conventional techniques well known in the art.

Furthermore, reference may be had to additional copending and coowned application Ser. Nos. 10/730,200; 10/349,339; 10/716,011; and 10/342,512, the disclosures of which are also incorporated herein by reference as if fully set forth herein, for a more detailed description of a conventional analog movement for hands 13, 14.

Dial 20, disclosed below in greater detail, is a thin flat member cut in the shape of a watch dial and preferably includes one or more holes 21 (e.g. formed by conventional punching or drilling) therein for accommodating the stems on which the one or more hands are mounted. Dial 20 is preferably mounted in case 2 by means of an insulating gasket 16, which supports dial 20 about its periphery, and assists in guarding against cracking or breakage of dial 20 as well as electrical insulation thereof.

FIGS. 1 and 2 illustrate a preferred construction of a multilayered assembly that forms dial 20 and the plurality of display segments $DS_1$–$DS_7$ comprising each of the display digits $D_1$–$D_4$ of secondary display 50. It should be understood that reference to "digit" is merely for convenience, since the display "digits" as set forth below, could also be arranged to display letters.

Specifically, dial 20, which is not drawn to scale but exaggerated in thickness for purposes of clarity, comprises a plurality of display segments $DS_1$–$DS_7$, each of which is made of a multilayered assembly comprising a transparent substrate 22, a first layer 23 of electrically conductive material, a second layer 24 of electroluminescent material, a third thin layer 25 of insulating moisture resistant barrier material and a fourth layer 26 of electrically conductive material. Additional details of each of these layers can be found in the aforementioned U.S. Pat. No. 4,775,964, and therefore, details of the preferred thicknesses, materials to form each layer, preferred masking steps to ensure good electrical connections to conductive layers 23 and 26 and the procedure to adhere the respective layers to each other, shall be omitted for purposes of brevity and because they are well known in the art.

Each digit $D_1$–$D_4$ preferably comprises seven (7) display segments $DS_1$–$DS_7$. In this way, selective illumination of the display segments allows for the display of the desired secondary information, since selective illumination can provide for the creation of any digit 0–9. Again, appropriate alignment of the display segments will permit the creation of letters, such as those to provide for month and/or day indicators. FIG. 2 illustrates, in cross-section, the horizontally elongated display segments $DS_5$ of the respective digits $D_3$, $D_4$, and the vertically oriented display segments $DS_4$, $DS_6$ of the respective digits $D_3$, $D_4$.

Figure 3:
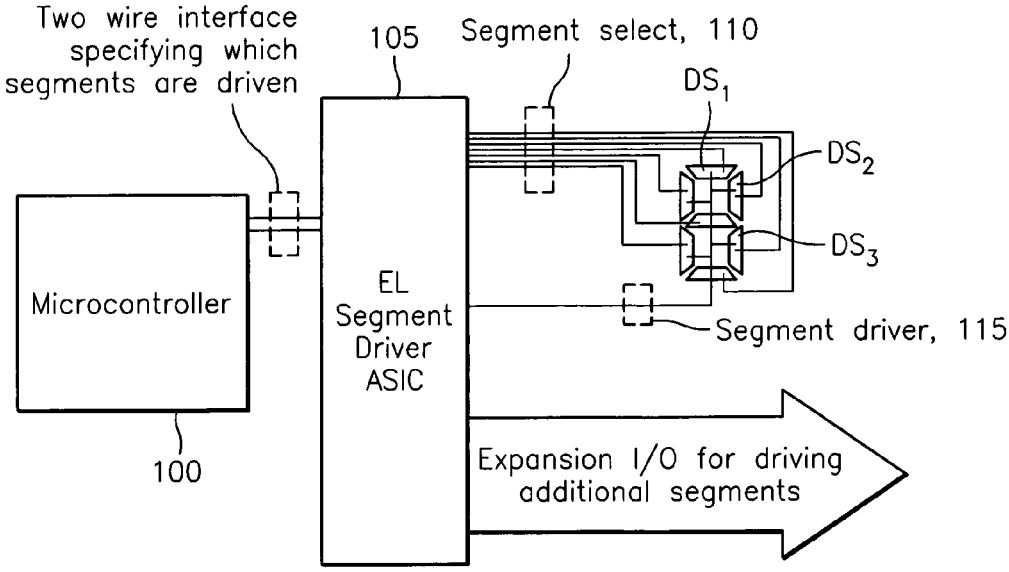
FIG. 3 is a simplified schematic of a circuit optimized for driving the secondary display of the present invention.

With the layering of display segments $DS_1$–$DS_7$ for each of the digits $D_1$–$D_4$ now fully disclosed, reference is now had to FIG. 3 in connection with a preferred circuit construction for driving the electroluminescent layers of the selected display segments of digits $D_1$–$D_4$.

Each segment $DS_1$–$DS_7$ of each digit $D_1$–$D_4$ represents a single electroluminescent panel that must be driven independently. The number of segments driven at any one time is dependent on the information to be displayed. Accordingly, a unique feature of the present invention is the ability to selectively drive multiple electroluminescent layers in order to provide for the display of secondary information, such as the date by way of example and not limitation.

FIG. 3 illustrates an electroluminescent drive circuit, which supplies drive pulses when actuated by an actuation means, such as by way of example and not limitation, an external push button actuator 60. Specifically, the circuit of FIG. 3 provides for the independent and selective driving of each display segment.

In the preferred embodiment, an electroluminescent segment driver, generally indicated at 105, comprises a high voltage driver circuit of the type set forth in the aforementioned '096 patent, and a digital logic circuit. A two-line interface couples EL segment driver 105 and microcontroller 100 (which may be of the type disclosed by reference numeral 100 in the aforementioned '417 application, and which therefore, in a preferred embodiment, also comprises the software and hardware to provide the functionality of the integrated circuit features disclosed above to carry out all the needed timekeeping functionality). Specifically, one output line carries data that will identify the display segments to be driven, while the other line preferably serves as the clock signal. It should be understood however, that a 2 line connection is only one of many possible configurations. For example, a parallel connection could be used, although it is deemed less than optimal. Upon the initiation of a request to display the secondary information, a data bit sequence associated with a particular display segment is transferred from microcontroller 100 to EL segment driver 105 on the rise or fall of clock signals. After a predetermined number of data bits associated with the display segment value has been transferred into the logic portion of EL segment driver 105, a segment selector 110 and a segment driver 115 are enabled. In this way, segment selector 110 selects the appropriate display segments for illumination while segment driver 115 provides the driving current therefor. The outputs that control segment selector 110 and segment driver 115 are enabled for a predetermined period of time as established by microcontroller 100. After the desired length of time that the respective electroluminescent layers are "energized" (which is merely a design choice within the purview of one skilled in the art), microcontroller 100 issues a command that disables segment driver 115 and segment selector 110, and the illumination is terminated. Alternatively (and/or additionally), a pre-defined 'on' time could be built into the ASIC thereby offloading some of the micro's work.

In the preferred embodiment, each digit (e.g. digits $D_1$–$D_4$) has associated with it a segment selector and segment driver of the aforementioned type, each of which is then electrically coupled to the display segments of that respective digit in the manner set forth above.

As illustrated, the multilayered display segments are preferably arranged in groups of seven (7), thus forming a plurality of seven (7) segment displays. For exemplary purposes, FIG. 1 illustrates four digits ($D_1$, $D_2$, $D_3$, $D_4$). An optional electroluminescent segment, referenced by indication "$D_{dash}$" may be provided to separate the month (e.g. "-") or the hour from the minute (e.g. ":") in the event that the secondary display is displaying time of day information. However, to be clear, providing yet additional display segments are within the scope of the present invention. For example, additional digits could be incorporated for displaying a day indicator (e.g. MON, TUE . . . ) and/or a year indicator, if the segments are arranged and aligned accordingly.

Since in the preferred embodiment, microcontroller 100 is the same controller used to control hands 13, 14, there is a constant degree of accuracy of information, such as time and date information, such that movement of hands 13, 14 through a 12 o'clock midnight position (either from a clockwise or counterclockwise direction) may be correctly reflected in the displayed secondary information displayed by display 50.

Moreover, by "secondary" it is merely intended to indicate the advantageous nature of the present invention of providing information in addition to that which is provided by hands 13, 14 (or any other hand). In no way is "secondary" intended to mean "inferior" or "of a lesser importance," but merely as terminology to differentiate it from, for example, the time of day if that is what the display hands are indicating. For example and not limitation, the "secondary" information may be date information (e.g. 22, 6-22, or 11-08) or an alternative timezone, for example. Likewise, if electronic device is a heartrate monitor for example, the secondary display and hence "secondary" information may in fact be the time of day. In a similar way, the secondary information could be a directional (e.g. compass) heading, a blood pressure display and/or speed and/or distance values.

Furthermore, one skilled in the art would know how to program such a controller such as controller 100, so that controlling, maintaining and/or setting accurate date and/or time information for display 50 need not be further disclosed.

Pusher 60, is preferably operatively coupled to controller 100 via a switch contact (not shown) to activate display 50 in the manner disclosed above. In this way, display 50, and in particular, digits $D_1$–$D_4$ and corresponding display segments $DS_1$–$DS_7$ can be appropriately illuminated to display the secondary information. Conventional features, such as controlling the display duration and/or brightness, may also be included, as described in various prior art patents. In this way, if desired, the user may adjust the brightness level of display 50 and/or select the particular length of time that she desires that display 50 be illuminated.

Additionally, the present invention provides for unique display sequencing. For example, as disclosed above, additional digits for displaying the year and/or a day (e.g. MON., TUE . . . ) may be included. Either way, whether there are for example, four digits $D_1$–$D_4$ (e.g. to display June 22→"06-22") or more, sequential actuation of pusher 60 could sequentially begin with only illuminating the "22" (i.e. the right-most digits $D_3$, $D_4$), while a subsequent actuation of pusher 60 (e.g. while the "22" is still illuminated) would additionally illuminate the "06" (i.e. $D_1$, $D_2$). Still further actuation could provide for the illumination of the "day" and/or the year. Such methodology for programming controller 100 is well with the scope of the skilled artisan. Likewise, multiple pushers could be used for the foregoing. Even further, the secondary information could be displayed after a timeout (e.g. the user pushes a pusher a single time, for example) and the electronic device (e.g. timepiece) displays the month for a few seconds and then the date for a few seconds, or visa versa, all such clever display routines being within the purview of the skilled artisan. The sequencing doesn't require additional button presses. It should also be understood that pusher 60 may also be incorporated into the crown itself, such that compression of the crown provides for the foregoing secondary display illumination. All such "switching means" for such secondary display illumination, including a switching means being incorporated into a rotating bezel (not shown) is contemplated herein.

In another advantageous embodiment, dial 20 is comprised of at least one additional multilayered assembly as set forth above, with this multilayered assembly comprising the remainder of the surface of dial 20. This additional multilayered assembly will also comprises means, such as its own segment selector and segment driver as set forth above, which are coupled to EL segment driver 105, for illuminating the electroluminescent layer of the at least one additional multilayered assembly. In this way, illumination of the electroluminescent layers of each of the display segments and illumination of the electroluminescent layer of this at least one additional multilayered assembly provides for at least essentially uniform illumination of the dial (i.e. at least essentially uniform backlighting for device 1). Accordingly, it is preferable that the illumination of the electroluminescent layers of each of the display segments and illumination of the electroluminescent layer of the at least one additional multilayered assembly occurs at least essentially simultaneously.

It can thus be seen that the present invention provides numerous advantages not found in the prior art. For example, the present invention provides an electronic device, such as a timepiece, with a desirable secondary display using electroluminescent technology. Further, the present invention utilizes an electroluminescent display to provide yet additional information that may be desirable to the user of the device. Additionally, the present invention provides a unique combination and aesthetically pleasing display using an optional electroluminescent backlight. Still further, the present invention provides an analog electronic device with a secondary display that is inexpensive and easy to manufacture. Still further, the present invention provides an electronic device, such as a timepiece, in which size of the date or other information desirous of display on the secondary display can be increased, while maintaining visual aesthetic appeal to the user.

While the invention has been particularly shown and described with respect to preferred embodiments thereof, it will be understood by those skilled in the art that changes in form and details may be made therein without departing from the scope and spirit of the invention.

To be sure for example, in the preferred embodiment, electronic timepiece 1 is a wristwatch, but other types of electronic devices, with and without sensors, such as a pocket watch as but one example, are also contemplated herein. Furthermore, pushbutton sequencing, such as using a mode button, may permit display 50 to display more than merely only a date or alternative timezone information, but rather both. Also, electronic device 1 may comprise additional pushers to set the date, time of day and/or alternative timezone information. Likewise, use of the crown may also be used for setting display 50 in a manner similar to the crown-set technology employed by Timex Corporation, whereby the displayed information, in this case the date or an alternative timezone, for example, can be set using the crown. In this embodiment, axial positioning of the crown and the use of electrical contacts can be used to set/change the date and/or set/change the secondary information in a consistent manner. Likewise, the brightness may be such that illumination of even selected display segments illuminates the entire dial for ease of reading the information conveyed by the hands, such as in the dark. Lastly, a coating of a reflective material may be provided to reflect light striking dial 20 from the dial side, if desired.

What is claimed is:

1. An electronic device for conveying first information by the use of at least one display hand, and having a secondary display for displaying secondary information, wherein the electronic device comprises:

an actuation mechanism, operatively coupled to the at least one display hand, for rotation thereof at least in one of a clockwise and counterclockwise direction; and a dial, positioned intermediate the at least one display hand and the actuation mechanism, wherein the dial comprises a plurality of display segments each of which is made up of a multilayered assembly comprising:

a transparent substrate having a first and a second surface;

a transparent electrically conductive layer formed on the second surface of the transparent substrate;

an electroluminescent layer formed on the transparent conductive layer;

an insulating layer formed on the electroluminescent layer; and an electrically conductive layer formed on the insulating layer;

means for selectively illuminating electroluminescent layers of each of the plurality of display segments;

wherein light emanating from the illuminated electroluminescent layers during an illuminated condition passes through the transparent substrate;

whereby secondary information is provided by the selected illumination of the electroluminescent layers.

2. The electronic device as claimed in claim 1, wherein the dial is comprised of at least one additional multilayered assembly as set forth in claim 1, wherein the electronic device further comprises means for illuminating the electroluminescent layer of the at least one additional multilayered assembly; and wherein illumination of the electroluminescent layers of each of the display segments and illumination of the electroluminescent layer of the at least one additional multilayered assembly provides for at least essentially uniform illumination of the dial.

3. The electronic device as claimed in claim 2, wherein the illumination of the electroluminescent layers of each of the display segments and illumination of the electroluminescent layer of the at least one additional multilayered assembly occurs at least essentially simultaneously.

4. The electronic device as claimed in claim 1, including switching means for initiating the illumination of the selected electroluminescent layers.

5. The electronic device as claimed in claim 1, wherein the at least one display hand is rotateable about a stem that projects through the dial, wherein the at least one display hand is positioned on the first side of the transparent layer forming part of the dial.

6. The electronic device as claimed in claim 1, comprising at least an hour hand and a minute hand for conveying at least time of day information and rotateable about a axis that projects through the dial, wherein the hour hand and the minute hand are positioned on the first side of the transparent substrate and wherein the actuation mechanism is operatively coupled to the hour hand and the minute hand for rotation thereof at least in one of a clockwise and counterclockwise direction.

7. The electronic device as claimed in claim 1, wherein the illuminated electroluminescent layers provide illumination of the dial outside of the area immediately above the electroluminescent layers to facilitate reading of the information conveyed by the at least one display hand.

8. The electronic device as claimed in claim 7, wherein the secondary information is the time of day.

9. The electronic device as claimed in claim 7, wherein the first hand is one for conveying heart rate information.

10. The electronic device as claimed in claim 1, wherein the means for selectively illuminating electroluminescent layers of each of the plurality of display segments comprises an electroluminescent drive circuit comprising:

an electroluminescent segment driver having a high voltage driver circuit and a digital logic circuit, wherein the electroluminescent segment driver is coupled to a controller, and wherein the controller provides data to the electroluminescent segment driver to identify the display segments to be driven; and a segment selector and a segment driver associated with a predetermined number of display segments, wherein data is transmitted from the electroluminescent driver to the segment selector for selection of the display segments to be illuminated.

11. The electronic device as claimed in claim 1, including means for sequentially illuminating selective electroluminescent layers of the display segments.

12. The electronic device as claimed in claim 1, wherein the secondary information is date information.

13. The electronic device as claimed in claim 1, wherein the electronic device is a timepiece.

* * * * *